US012642347B2

(12) United States Patent
Schwager

(10) Patent No.: US 12,642,347 B2
(45) Date of Patent: Jun. 2, 2026

(54) CARRYING SYSTEM FOR AN ITEM OF EQUIPMENT

(71) Applicant: Lindnerhof-Taktik GmbH, Lenggries (DE)

(72) Inventor: Martin Schwager, Penzberg (DE)

(73) Assignee: LINDNERHOF-TAKTIK GMBH, Lenggries (DE)

( * ) Notice: Subject to any disclaimer, the term of this patent is extended or adjusted under 35 U.S.C. 154(b) by 158 days.

(21) Appl. No.: 18/324,740

(22) Filed: May 26, 2023

(65) Prior Publication Data

US 2023/0380577 A1 Nov. 30, 2023

(30) Foreign Application Priority Data

May 30, 2022 (DE) ..... 20 2022 103 036.7

(51) Int. Cl.
*A45F 3/10* (2006.01)

(52) U.S. Cl.
CPC ..... *A45F 3/10* (2013.01)

(58) Field of Classification Search
CPC ..... A45F 3/08; A45F 3/10; A62B 25/00
USPC ..... 410/49, 50; 224/628
See application file for complete search history.

(56) References Cited

U.S. PATENT DOCUMENTS 2,621,807 A * 12/1952 Rendich ..... B23Q 16/001 269/297
3,250,529 A * 5/1966 Eissfeldt ..... G06K 13/063 271/221
3,774,825 A * 11/1973 Schone ..... A45F 3/10 224/265
4,593,804 A * 6/1986 Kinsey ..... H05K 13/0069 193/41
5,131,576 A * 7/1992 Turnipseed ..... A45F 3/08 224/907
5,193,700 A * 3/1993 Lyman ..... B65D 19/44 206/386
5,499,724 A * 3/1996 Hickman ..... B25H 3/04 211/70.6
5,732,867 A * 3/1998 Perkins ..... A45F 3/08 224/628
5,813,550 A * 9/1998 Sheehan ..... A47F 5/0807 248/220.31

(Continued)

FOREIGN PATENT DOCUMENTS

DE 3232143 A1 3/1984
DE 10033738 A1 1/2002

(Continued)

OTHER PUBLICATIONS

Canadian Intellectual Property Office, Office Action Issued in Application No. 3,208,263, Dec. 13, 2024, 6 pages.

(Continued)

*Primary Examiner* — Justin M Larson
(74) *Attorney, Agent, or Firm* — McCoy Russell LLP

(57) ABSTRACT

The present disclosure discloses a carrying system for an item of equipment having a load carrier that can be carried via shoulder straps, the load carrier comprising a carrying plate having a plurality of recesses, at least one clamping element, and at least one positioning element, wherein the at least one clamping element and the at least one positioning element are each arranged or arrangeable on at least one recess of the carrying plate.

23 Claims, 7 Drawing Sheets

(56) References Cited

U.S. PATENT DOCUMENTS 5,853,092 A * 12/1998 Goodman ..... A47F 5/0823 211/106.01
5,888,039 A * 3/1999 Cooley ..... B60P 7/0823 410/97
6,085,916 A * 7/2000 Kovacevic ..... A47F 5/0815 211/87.01
6,155,470 A * 12/2000 Robison ..... F41B 5/1461 224/259
D460,902 S * 7/2002 Battle ..... D7/708
6,575,313 B1 * 6/2003 Chen ..... B25H 3/06 211/DIG. 1
6,926,243 B1 * 8/2005 Ziaylek ..... A62B 25/00 248/307
7,131,561 B2 * 11/2006 Humes ..... B60R 9/08 224/310
7,244,084 B2 * 7/2007 Anthony ..... B60P 7/12 410/47
8,522,986 B2 * 9/2013 Kitchen ..... B25H 3/04 248/220.31
8,695,171 B2 4/2014 Colorado
8,739,982 B2 * 6/2014 Werner ..... F41A 23/18 211/119.003
8,844,781 B2 * 9/2014 Rose ..... A45C 13/30 224/628
8,950,644 B2 * 2/2015 Gleason, Jr. ..... A45F 3/12 224/901.8
9,022,267 B2 * 5/2015 Wisselmann ..... B60R 11/00 224/567
D735,540 S * 8/2015 Carpenter ..... D7/704
9,232,848 B2 * 1/2016 Krikorian ..... A45F 3/08
9,586,065 B2 * 3/2017 Losos ..... A62B 9/04
9,610,903 B1 * 4/2017 Al-Hasan ..... B60R 11/06
9,820,556 B2 * 11/2017 Adams ..... A45F 3/08
9,999,290 B2 * 6/2018 Klein ..... A45F 3/08
10,251,467 B2 * 4/2019 Donhauser ..... A45F 3/12
10,357,097 B1 7/2019 Goldberg
10,448,735 B2 * 10/2019 Carpenter ..... A47B 73/00
10,470,553 B1 11/2019 Gonzalez
11,045,671 B2 * 6/2021 Saggio ..... A62B 25/00
11,076,709 B2 * 8/2021 Gillespie ..... F16B 5/0056
11,229,276 B2 1/2022 Simione
11,641,893 B2 * 5/2023 Saggio ..... A41D 13/0531 224/633
11,690,438 B2 * 7/2023 Rorich ..... A45F 3/06 224/631
11,786,030 B2 * 10/2023 Salentine ..... A45F 5/00 2/102
12,029,316 B2 * 7/2024 Herman ..... A47B 96/021
12,064,026 B2 * 8/2024 Wilsey ..... A45F 3/12
12,070,658 B2 * 8/2024 Fox ..... A63B 47/001
2005/0000993 A1 1/2005 Moskun
2006/0208024 A1 9/2006 Gleason, Jr.
2006/0289589 A1 12/2006 Gregory
2007/0158380 A1 7/2007 Calkin
2008/0257922 A1 10/2008 Cragg
2012/0227209 A1 * 9/2012 Vinson ..... A47L 5/36 224/259
2014/0361058 A1 12/2014 Gill et al.
2015/0189974 A1 7/2015 Bercaw et al.
2015/0208791 A1 * 7/2015 Klein ..... A45F 3/08 224/633
2016/0033235 A1 2/2016 Kinnings
2017/0311704 A1 11/2017 Geller
2020/0275763 A1 9/2020 Lennings et al.
2021/0274859 A1 * 9/2021 Saggio ..... A45F 3/06
2022/0007818 A1 1/2022 Rorich
2023/0380577 A1 * 11/2023 Schwager ..... A45F 3/08
2024/0041189 A1 * 2/2024 Schwager ..... A45F 3/047
2024/0041190 A1 * 2/2024 Schwager ..... A45F 3/10

FOREIGN PATENT DOCUMENTS

DE 202008000644 U1 3/2008
KR 101837380 B1 3/2018
WO 8701017 A1 2/1987
WO 2006102091 A2 9/2006
WO 2006104368 A1 10/2006

OTHER PUBLICATIONS

Canadian Intellectual Property Office, Office Action Issued in Application No. 3,208,264, Dec. 13, 2024, 6 pages.
Canadian Intellectual Property Office, Office Action Issued in Application No. 3,208,263, Aug. 1, 2025, 3 pages.

* cited by examiner

CARRYING SYSTEM FOR AN ITEM OF EQUIPMENT

CROSS-REFERENCE TO RELATED APPLICATION

The present application claims priority to German Patent Application No. 20 2022 103 036.7 filed on May 30, 2022. The entire contents of the above-listed application are hereby incorporated by reference for all purposes.

TECHNICAL FIELD

The present disclosure relates to a carrying system for an item of equipment comprising a load carrier which can be carried via shoulder straps, the load carrier comprising a carrying plate having multiple recesses, at least one clamping element and at least one positioning element, wherein the at least one clamping element and the at least one positioning element are each arranged or arrangeable on at least one recess of the carrying plate.

BACKGROUND

Such a carrying system is known from document US 2022/0007818 A1. The carrying system shown in this publication is used for transporting chain saws, circular saws or hammers, such as those required by firefighters, and allows these items of equipment to be transported on the back in the manner of a backpack. The items of equipment are clamped to the carrying plate by one or more clamping straps, while the positioning elements serve as stops that prevent the items of equipment from slipping out. The shoulder straps are attached to slots in the carrying plate.

It is true that in US 2022/0007818 A1 some of the positioning elements are slidably mounted on slotted holes, so that the carrying system can be adapted to slight differences in the items of equipment. However, it is still tailored to a very specific application. In addition, it is difficult to brace the items of equipment to the system in such a way that it is immovably fixed to the carrying plate. Furthermore, it is not adaptable to the respective wearer.

It is therefore the object of the present disclosure to provide an improved carrying system.

SUMMARY

This object is solved in several aspects by the systems described herein.

In a first independent aspect, the present disclosure comprises a carrying system for an item of equipment comprising a load carrier which can be carried via shoulder straps, the load carrier comprising a carrying plate having a plurality of recesses, at least one clamping element and at least one positioning element, wherein the at least one clamping element and the at least one positioning element are each arranged or arrangeable on at least one recess of the carrying plate. The first aspect is characterized in that a plurality of positioning elements are provided, against which the item of equipment can be clamped by the clamping element, wherein the positioning elements are arranged or arrangeable on both sides of the course of the clamping element, so that the item of equipment rests against the positioning elements on both sides of the clamping element in the clamped state. The item of equipment is thereby securely fixed to the load carrier.

In one possible embodiment, it is provided that the positioning elements and the clamping element are arranged or can be arranged in such a way that the load is applied to the carrying plate exclusively via the clamping element or elements and the positioning elements. This achieves improved fixation and prevents wear on the carrying plate.

In a possible embodiment, it is provided that the positioning elements and the clamping element are arranged or arrangeable such that the equipment item is fixed by the at least one clamping element between positioning elements arranged on both sides of the clamping element and on both sides of a main direction of the item of equipment running transversely to the clamping element.

In a second independent aspect, the present disclosure comprises a carrying system for an item of equipment, in particular a carrying system such as described herein, comprising a load carrier which can be carried via shoulder straps, wherein the load carrier comprises a carrying plate having a plurality of recesses, at least one clamping element and at least one positioning element, wherein the at least one clamping element and the at least one positioning element are each arranged or arrangeable on at least one recess of the carrying plate. The second aspect is characterized in that an outer contour of the at least one positioning element has a shape tapering in one direction and/or a rotationally symmetrical cross-section. As a result, secure clamping with the positioning elements is possible and the positioning elements can be used for any item of equipment.

In one possible embodiment, a part of the at least one positioning element that has a shape tapering continuously in one direction has a height that is at least 20% of the total height of the positioning element, preferably at least 50%.

In one possible embodiment, it is provided that the outer contour of the at least one positioning element has a shape that tapers continuously in one direction, in particular a cross-section that tapers continuously in one direction.

In one possible embodiment, it is provided that the outer contour of the at least one positioning element has a rotational symmetry, in particular an n-numbered rotational symmetry with n greater than or equal to 2, preferably greater than or equal to 3 or 6, and/or in particular a cylindrical symmetry. With an n-numbered rotational symmetry, the outer contour is mapped back into itself for each rotation through an angle of 360°/n or a multiple thereof. A regular hexagon therefore has, for example, a 6-count rotational symmetry. In a cylindrical symmetry, rotations by arbitrary angles map the outer contour back into itself.

In one possible embodiment, it is provided that the one direction and/or axis of symmetry is perpendicular to the carrying plate and/or coincides with the longitudinal axis of a screw by means of which the positioning element is screwed and/or screwable to the carrying plate.

In one possible embodiment, it is provided that the item of equipment has a tapering shape in that region in which it rests on a positioning element. In this case, the positioning element itself need not have a tapering shape to achieve the effect described above. The positioning element can, for example, have a flat top side and/or a cylindrical shape.

In a third independent aspect, the present disclosure comprises a carrying system for an item of equipment, in particular a carrying system such as described herein, comprising a load carrier which can be carried via shoulder straps, wherein the load carrier comprises a carrying plate having a plurality of recesses, at least one clamping element and at least one positioning element, wherein the at least one clamping element and the at least one positioning element are each arranged or arrangeable on at least one recess of the carrying plate. The third aspect is characterized in that the carrying plate is sewn into a fabric pocket and/or consists of an aluminum-plastic laminate material. This provides a conveniently usable, stable and lightweight configuration.

In one possible embodiment, it is provided that the recesses in the carrying plate are formed by holes, wherein cutouts are provided in the material of the fabric pocket which match the holes, wherein the cutouts are preferably cut out of the fabric by means of a laser.

In one possible embodiment, it is provided that the carrying plate is connected and/or connectable to the shoulder straps via the fabric pocket.

In one possible embodiment, it is provided that the connection is a releasable connection.

In one possible embodiment, it is provided for one or more fastening elements to be provided on the fabric pocket for attachment with the shoulder straps.

The shoulder straps can be attached to the load carrier indirectly via another element or directly.

In a fourth independent aspect, the present disclosure comprises a carrying system for an item of equipment, in particular a carrying system such as described herein, comprising a load carrier which can be carried via shoulder straps, wherein the load carrier comprises a carrying plate having a plurality of recesses, at least one clamping element and/or at least one positioning element, wherein the at least one clamping element and the at least one positioning element are each arranged or arrangeable on at least one recess of the carrying plate. The fourth aspect is characterized in that the load carrier is fastened and/or fastenable to a carrying frame on which the shoulder straps are arranged, in particular is releasably fastened and/or fastenable. This allows a particularly comfortable carrying as well as a modular structure.

In one possible embodiment, it is provided that the carrying frame further comprises a waist belt, wherein the carrying frame preferably connects the shoulder straps and the waist belt to one another.

In one possible embodiment, the at least one clamping element and the at least one positioning element are directly connected, in particular screwed, to the supporting plate of the load carrier, while the at least one clamping element and the at least one positioning element are not directly connected to the carrying frame, but only indirectly via the connection of the load carrier to the carrying frame.

In one possible embodiment, the carrying frame is an independent element, which can be carried by a wearer in the manner of a backpack. The load carrier can be releasably attached to this carrying frame.

In particular, the positioning elements and the clamping elements can be connected to the load carrier while the load carrier is not attached to the carrying frame, and the load carrier can releasably connected to the carrying frame with the positioning elements and the clamping elements already connected to it.

The first through fourth aspects of the present disclosure are each per se and independently subject matter of the present disclosure.

However, the aspects can also be combined in arbitrary manner. For example, the first aspect may be combined with the second aspect, the third aspect, or the fourth aspect. Similarly, the second aspect may be combined with the third aspect or the fourth aspect. Similarly, the third aspect may be combined with the fourth aspect. Furthermore, three aspects may also be combined with each other in any combination. Likewise, all four aspects can be combined with each other.

Possible embodiments of all four aspects, as well as any combinations of these aspects, are described in greater detail below.

In one possible embodiment, a maximum width of the at least one positioning element and preferably of several or all of the positioning elements, measured in a direction parallel to the carrying plate, is at least 20% of the height of the respective positioning element or positioning elements, the height being measured in a direction perpendicular to the carrying plate, wherein both the maximum width and height are measured in a state where the positioning element or elements are fastened to the carrying plate. Preferably, the maximum width is at least 30% of the height, further preferably at least 40%, further preferably at least 50% and at least 60%.

In one possible embodiment, a lower surface of the at least one positioning element and preferably of several or all of the positioning elements abuts on a main surface of the carrying plate, and a pin of the positioning element reaches into and/or through the recess for connecting the respective positioning element to the carrying plate.

In one possible embodiment, a width of a lower surface of the at least one positioning element is at least twice as large as a diameter of the pin and/or the recess, preferably at least three or four times as large.

In one possible embodiment, the pin is part of a screw connection and has a screw thread for being screwed into a screw hole of the positioning element or of a nut provided on a back side of the carrying plate.

In one possible embodiment, the outer contour of the positioning elements is formed by an elastic material, in particular rubber. In particular, the positioning elements can be rubber elements.

In one possible embodiment, the carrying system comprises a plurality of identical positioning elements.

In one possible embodiment, the carrying system comprises one or more first and second positioning elements that have different sizes and/or different shapes.

In one possible embodiment, it is provided for an outer contour of the one or more first positioning elements to have a shape that tapers in one direction and that for one or more second positioning elements to have the shape of a circular cylinder.

In one possible embodiment, it is provided for the first and second positioning elements to have an outer contour that tapers in one direction, but to have different sizes.

In one possible embodiment, the carrying system includes one or more first, second, and third positioning elements that have different sizes and/or different shapes.

In one possible embodiment, it is provided for multiple and/or all positioning elements to have a rotationally symmetrical cross-section.

In one possible embodiment, the carrying system comprises at least 4 and preferably at least 5 or 6 positioning elements, wherein preferably at least 4 positioning elements are provided, the outer contour of which has a shape that tapers in one direction.

In one possible embodiment, it is provided for the one or more positioning elements and/or clamping elements to be screwed and/or screwable to the carrying plate.

In one possible embodiment, it is provided that a threaded pin is arranged on each of the positioning element(s) and/or clamping element(s) and is screwable to a nut provided on the rear side of the carrying plate facing the body of the wearer.

In one possible embodiment, it is provided that a female thread is arranged on each of the positioning element(s)

and/or clamping element(s) and can be screwed to a screw the head of which is provided on the rear side of the carrying plate facing the body of the wearer.

In one possible embodiment, it is provided that the at least one clamping element comprises a strap element and a strap-receiving element, wherein the strap element is preferably made of plastic and/or has locking edges, and/or wherein the strap-receiving element preferably permits lashing of the strap element and in particular comprises a tensioning ratchet.

In one possible embodiment, it is provided that the strap element and/or the strap-receiving element are each arranged so as to be pivotable about an axis on a fastening element which can be fastened to a recess in the carrying plate.

In one possible embodiment, it is provided that the strap element and the strap-receiving element are arrangeable independently of one another on recesses of the carrying plate.

In one possible embodiment, it is provided that the strap element and the strap-receiving element are arranged on a common base element, via which they can be arranged on one or more recesses of the carrying plate.

In one possible embodiment, it is provided for the carrying plate to have a plurality of recesses arranged in a grid, at which the positioning element(s) and clamping element(s) can be arranged in different positions for adaptation to different items of equipment.

In one possible embodiment, it is provided that the carrying plate has a plurality of recesses which are specifically adapted in terms of their position to the item of equipment to be carried, and on which the positioning element or elements and clamping elements for holding the item of equipment are provided in a defined arrangement.

In one possible embodiment, the carrying system comprises a set of positioning elements and/or clamping elements that can be used in different combinations and/or arrangements to adapt to different items of equipment.

The present disclosure further comprises a set of a load carrying system as described above and the at least one item of equipment fastenable and/or fastened to the load carrier.

This results in the advantages already described above. In particular, the clamping element(s) and/or positioning element(s) are arranged on the load carrier in such a way that the item of equipment can be braced to these, as described above.

The present disclosure further comprises a load carrier for one of the carrying systems as described above. The load carrier thereby comprises a carrying plate having a plurality of recesses, at least one clamping element and/or at least one positioning element, wherein the at least one clamping element and the at least one positioning element are each arranged or arrangeable on at least one recess of the carrying plate, wherein these are configured as described in more detail above with respect to the carrying systems according to the disclosure.

The load carrier is connectable to shoulder straps in order to form a carrying system in accordance with the present disclosure.

Preferably, this can occur by connecting the load carrier to a carrying frame to which the shoulder straps are arranged, as described according to the fourth aspect.

The present disclosure further comprises the use of the carrying systems as described above for transporting an item of equipment.

BRIEF DESCRIPTION OF THE FIGURES

The present disclosure will now be described in greater detail with reference to exemplary embodiments and drawings.

Shown are in.

DETAILED DESCRIPTION

Figure 9:
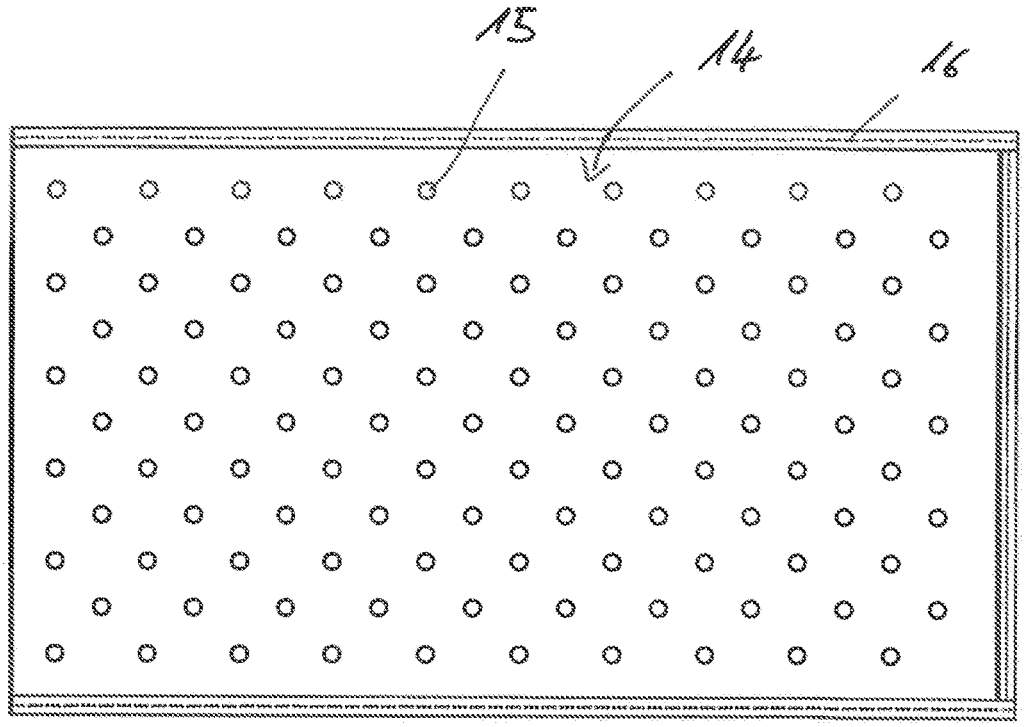
FIG. 9: a carrying plate for a load carrier of the present disclosure, which is sewn into a fabric sleeve.
Figure 10:
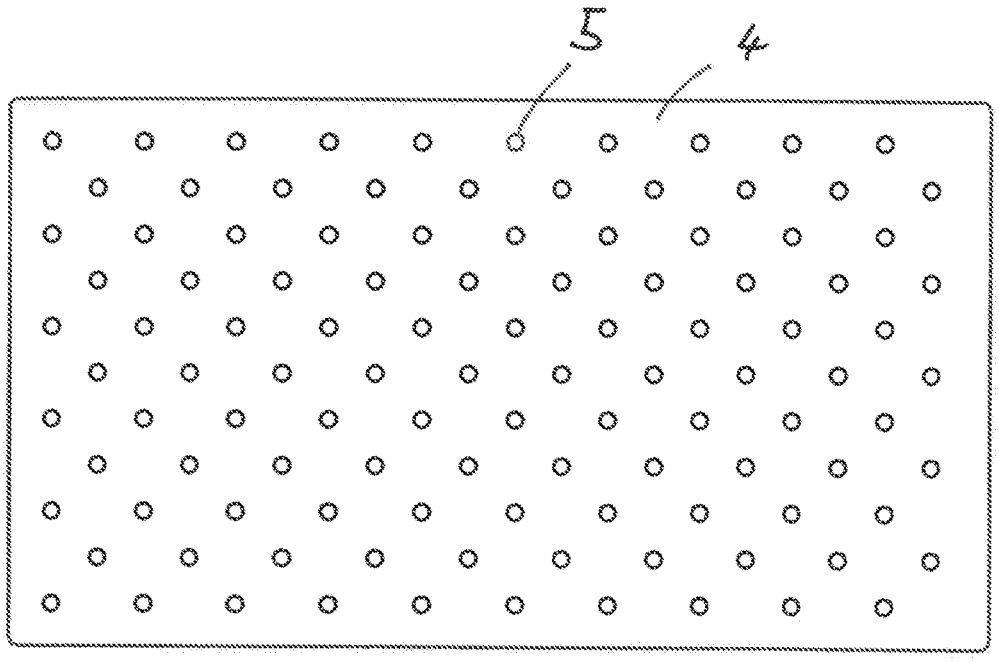
FIG. 10: a carrying plate according to the disclosure.
Figure 11:
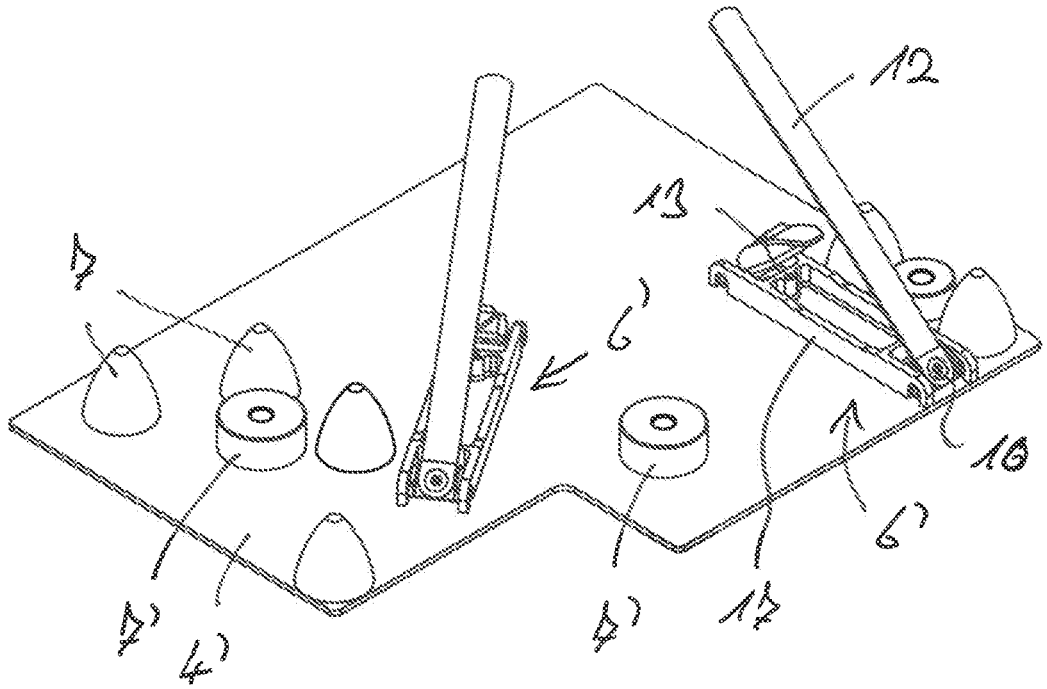
FIG. 11: a second embodiment of a load carrier according to the disclosure and, FIG. 12: the second embodiment shown in FIG. 11 in a perspective view from a side facing the back of the wearer.
Figure 12:
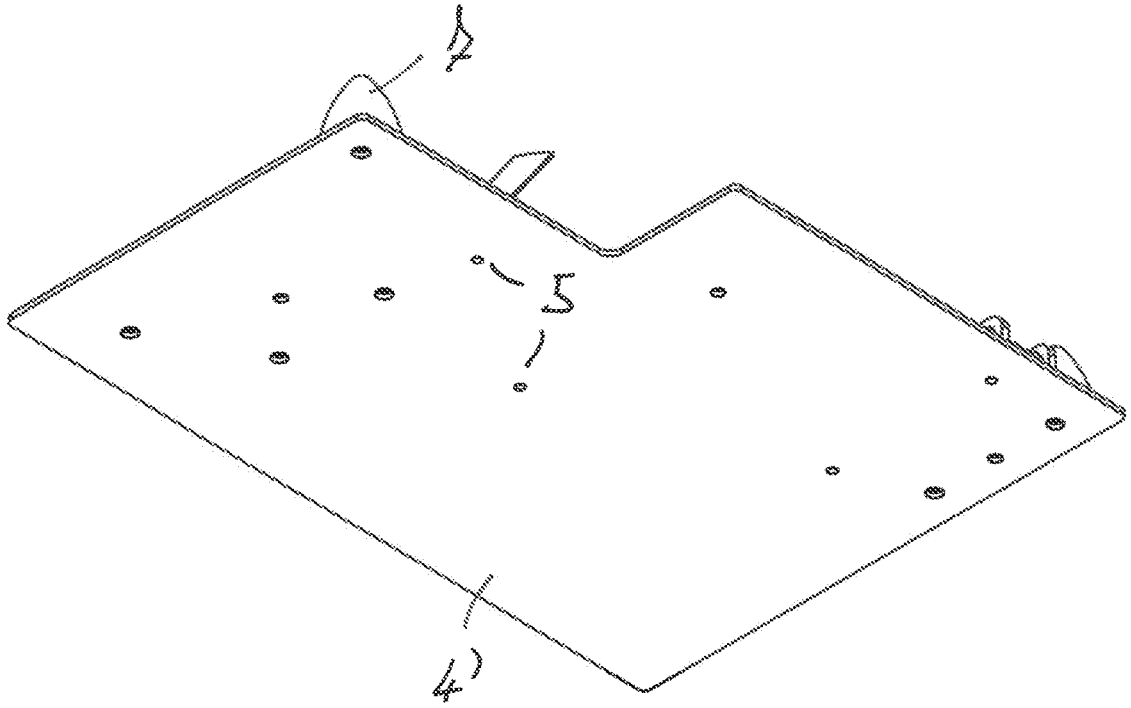

A carrying system according to the present disclosure and a load carrier used therefor are shown in FIGS. 1-10 in a first embodiment and in FIGS. 11 and 12 in a second embodiment.

The carrying system for an item of equipment 1 according to the disclosure comprises a load carrier 2, which can be worn on the back via shoulder straps 3.

The load carrier 2 comprises a carrying plate 4, on which at least one clamping element 6 and/or one positioning element 7 is arranged and/or can be arranged. For this purpose, the carrying plate comprises recesses 5 on which the clamping element 6 and/or the positioning elements 7 can be arranged.

In the exemplary embodiment, the recesses extend through the carrying plate 4, and in particular enable the clamping elements and/or positioning elements to be screwed to the carrying plate. As discernible in particular in FIGS. 2 and 5, the clamping element and/or the positioning elements can have threaded pins which pass through the recesses in the carrying plate and are screwed to the side of the carrying plate facing the back of the wearer with screw nuts in order to secure them to the carrying plate. In an alternative embodiment, the clamping elements and/or positioning elements may have female threads into which screws are screwed which pass through the recesses in the carrying plate and whose heads are arranged on the side of the carrying plate facing the back of the wearer.

In the exemplary embodiment, each recess in the carrying plate defines a unique position for a clamping element and/or a positioning element. In alternative embodiments, however, the use of slotted holes would also be conceivable in order to be able to connect the clamping elements and/or positioning elements to the carrying plate at any position along such a slotted hole. However, the configuration shown in the exemplary embodiment with defined positions provided by the recesses increases stability and reduces wear. The recesses preferably have the form of circular apertures.

The exemplary embodiments described according to the disclosure implement all independent aspects of the present disclosure in combination. However, the specific embodiments described for the individual aspects can each also be used independently of one another.

Figure 1:
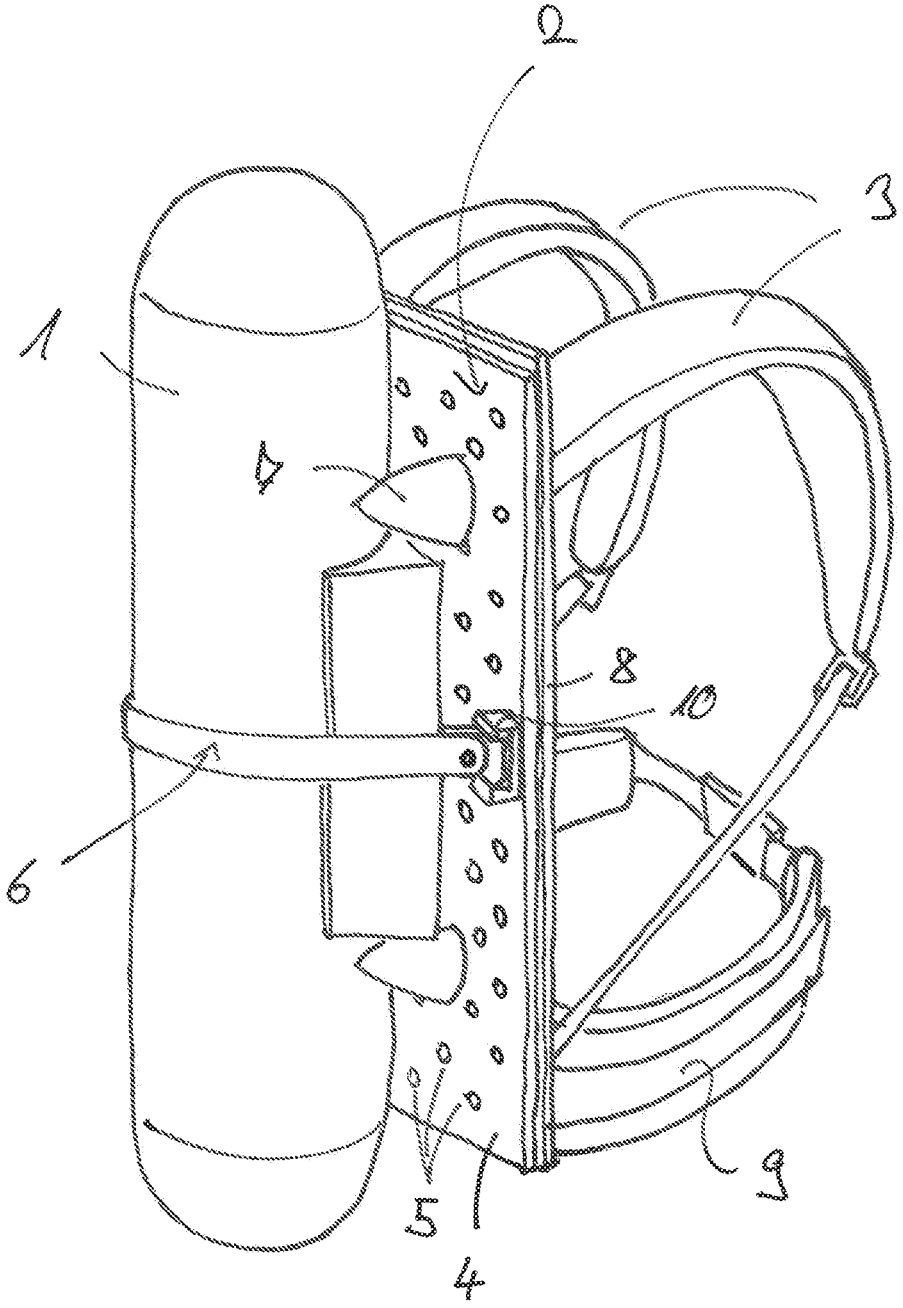
FIG. 1: A first exemplary embodiment of a carrying system according to the disclosure in a perspective view.
Figure 7:
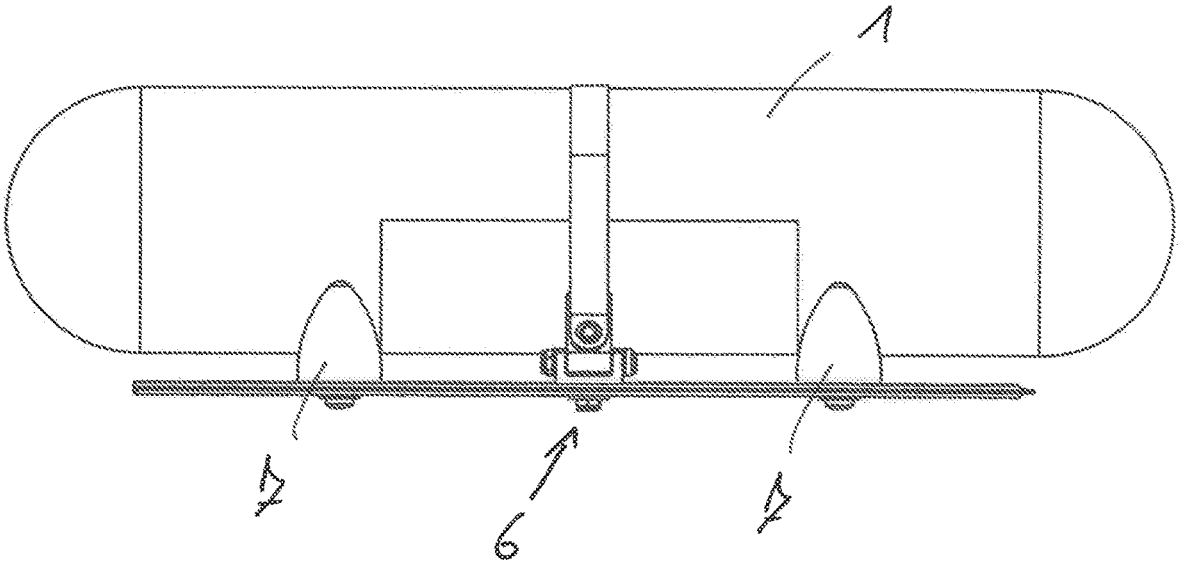
FIG. 7: a side view of the load carrier according to the disclosure.
Figure 8:
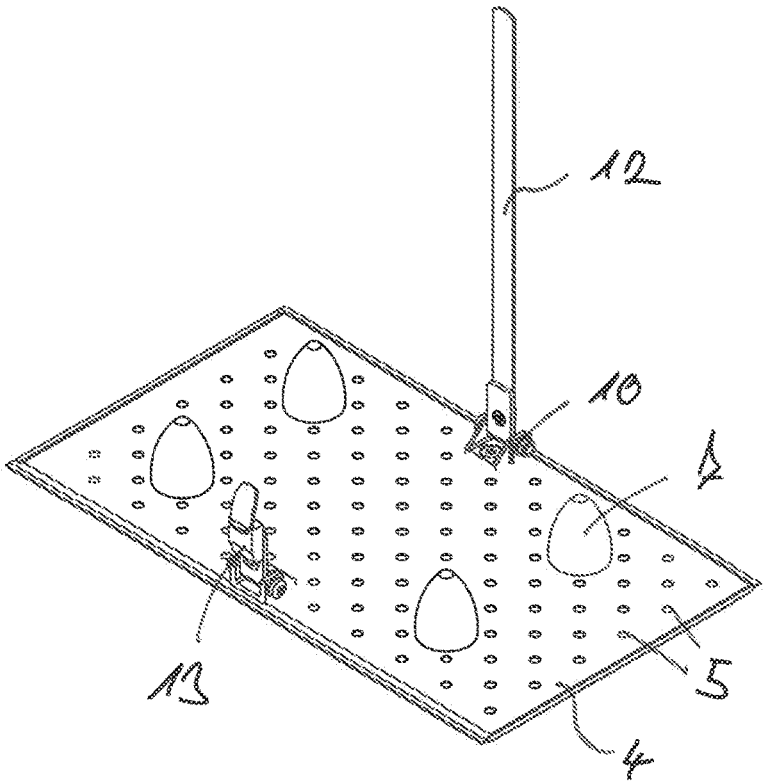
FIG. 8: the load carrier according to the disclosure, with the item of equipment removed and the clamping element opened.

According to a first aspect of the disclosure, as clearly discernible in FIGS. 1, 7 and 8, for example, a plurality of positioning elements 7 are provided in accordance with the disclosure, which are arranged on both sides of the clamping element 6 and therefore fix the item of equipment on both sides of the clamping element 6. In particular, the item of equipment 1 is here clamped or braced on both sides of the clamping element 6 in each case with positioning elements 7.

As can be taken in particular from FIGS. 7 and 8, the item of equipment does not come into direct contact with the carrying plate, but in this exemplary embodiment is rather in contact exclusively with the clamping element and the positioning elements, so that the load introduction to the carrying plate takes place exclusively via these elements. In this way, the item of equipment is held particularly securely on the load carrier and wear of the carrying plate is avoided.

In the exemplary embodiment, at least two positioning elements 7 are provided on each side of the clamping element 6, so that on both sides of the clamping element the item of equipment is held on both sides with respect to its longitudinal axis running transversely to the clamping element by the positioning elements by being pressed against them by the clamping element.

In contrast to the prior art, the positioning elements are therefore not used to prevent slippage of the item of equipment clamped between the carrying plate and the clamping element. Rather, the clamping takes place with the positioning elements, and not with the carrying plate itself.

As shown in the exemplary embodiment in FIGS. 11 and 12, of course also multiple clamping elements 6' can be used. Here, too, with respect to at least one clamping element, at least one positioning element is provided on both sides of the clamping element, against which the item of equipment is clamped or clamped. Preferably, with respect to all clamping elements, at least one positioning element is provided on both sides in each case, with which clamping takes place.

According to a second aspect of the present disclosure, the outer contour of at least one positioning element tapers in one direction and/or the positioning element has its rotationally symmetric outer contour.

The one direction or axis of rotational symmetry is preferably perpendicular to the carrying plate, and can in particular coincide with the axis of the screw connection by means of which the positioning element can be screwed to the carrying plate.

The positioning elements 7 have an outer contour that tapers continuously in a direction away from the back of the wearer. The positioning elements 7 have a conical shape, with their outer contour being of convex shape in a longitudinal section.

The positioning elements 7', on the other hand, are cylindrical with a flat top side.

In the exemplary embodiment, the positioning elements 7 and 7' are designed as rotational bodies. However, they could also have a multiple symmetry.

As can be taken from the exemplary embodiments, preferably at least 4 positioning elements with a tapering outer contour are provided between which the item of equipment can be clamped. The cylindrical positioning elements 7' can additionally be used to prevent contact of the item of equipment with the carrying plate and to enable secure clamping with the tapering positioning elements.

On the one hand, the shape of the positioning elements means that they can be used universally and independently of the specific shape of the item of equipment. On the other hand, the positioning elements, which are designed with a tapered outer contour, allow the item of equipment to be securely lashed, which enables the item of equipment to be fixed securely and without wobbling to the load carrier simply by lashing it between the clamping element and the positioning elements.

Other shapes for the outer contours of the positioning elements would also be conceivable. For example, these could also have a polygonal cross-section, for example be hexagonal or octagonal in shape. However, the circular cross-section enables even more secure positioning since clamping or tensioning does not depend on the rotational position of the positioning element relative to the item of equipment. Furthermore, cone-shaped positioning elements would also be conceivable.

Furthermore, depending on the item of equipment, only positioning elements with a flat top side, such as positioning elements 7', can be used and positioning elements with a tapering outer contour can be dispensed with. If the item of equipment itself has a tapering contour, safe lashing is also possible using positioning elements having a flat top side.

As can be seen in particular in FIGS. 9 and 10, the carrying plate 4 is sewn into a fabric pocket 14 according to a third aspect. In particular, fabric is placed around the carrying plate 4 and sewn in the edge areas via seams 16.

According to a second variant of the third aspect, the carrying plate consists of an aluminum-plastic laminate material. In particular, at least 2 aluminum layers are provided in this case, between which extends at least one synthetic material layer. For example, the material may be Aluminum Dibond.

In this embodiment, the recesses 5 in the carrying plate 4 can be formed by holes. Corresponding cutouts are provided in the material of the fabric pocket, which match these holes 5. The cutouts are preferably cut out by a laser from the fabric from which the fabric pocket is made.

Sewing the carrying plate into a fabric pocket on the one hand increases user comfort, and on the other hand allows easier connection of the carrying plate to other components via the fabric pocket into which the carrying plate is sewn.

In particular, the carrying plate 4 can be connected or connectable to the shoulder straps 3 via the fabric pocket 14. Preferred is a releasable connection of the fabric pocket to the shoulder straps.

In particular, one or more fasteners may be provided on the fabric pocket for indirect or direct attachment with the shoulder straps.

In particular, the fabric pocket may be connectable, in particular releasably connectable, to a carrying frame to which the shoulder straps are arranged, and which will be described in more detail with respect to the fourth aspect below.

For example, the fabric pocket can have a downwardly open pocket in an upper area, with which it is pushed over an upper edge of the carrying frame. Likewise, fastening by means of zippers is possible.

Figure 2:
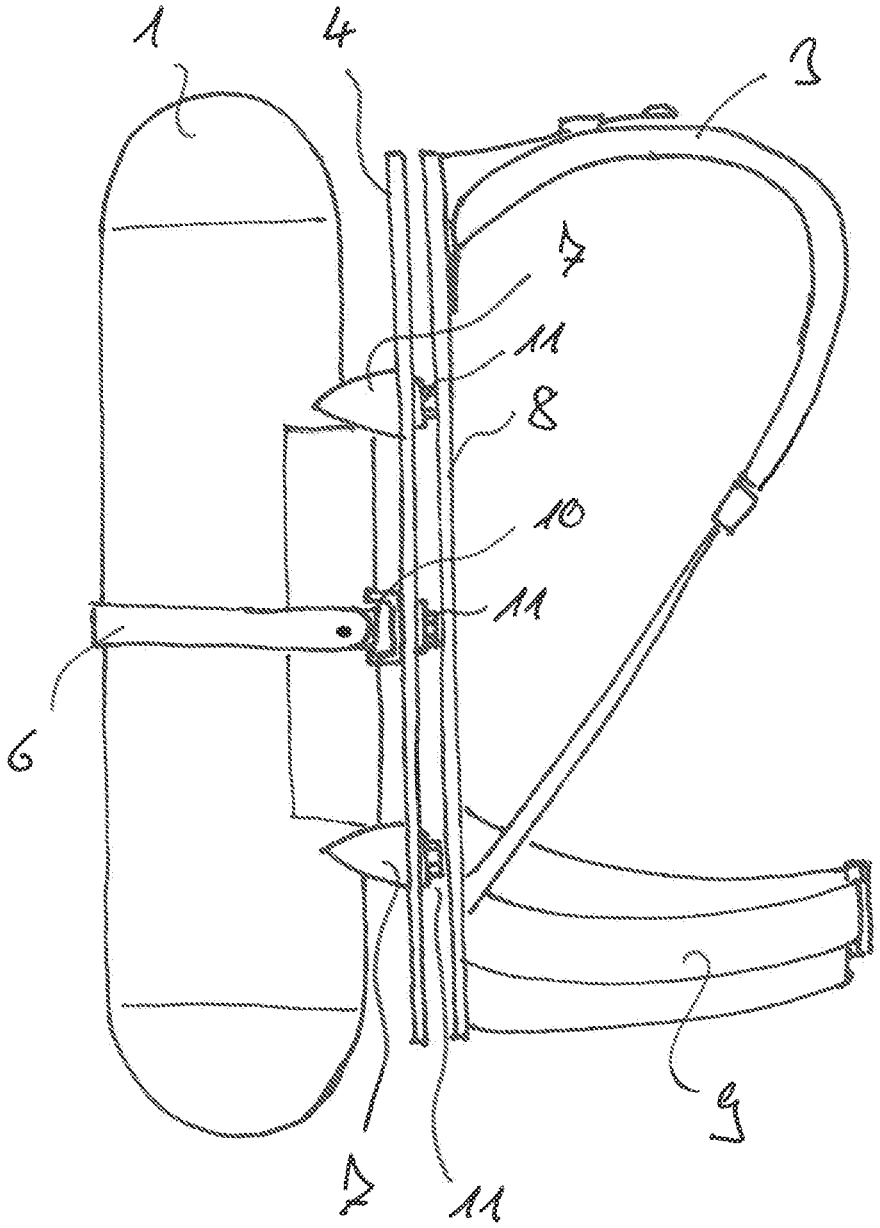
FIG. 2: a side view of the carrying system shown in FIG. 1, FIG. 3: a rear view of the load carrier used in FIGS. 1 and 2 according to the disclosure.
Figure 3:
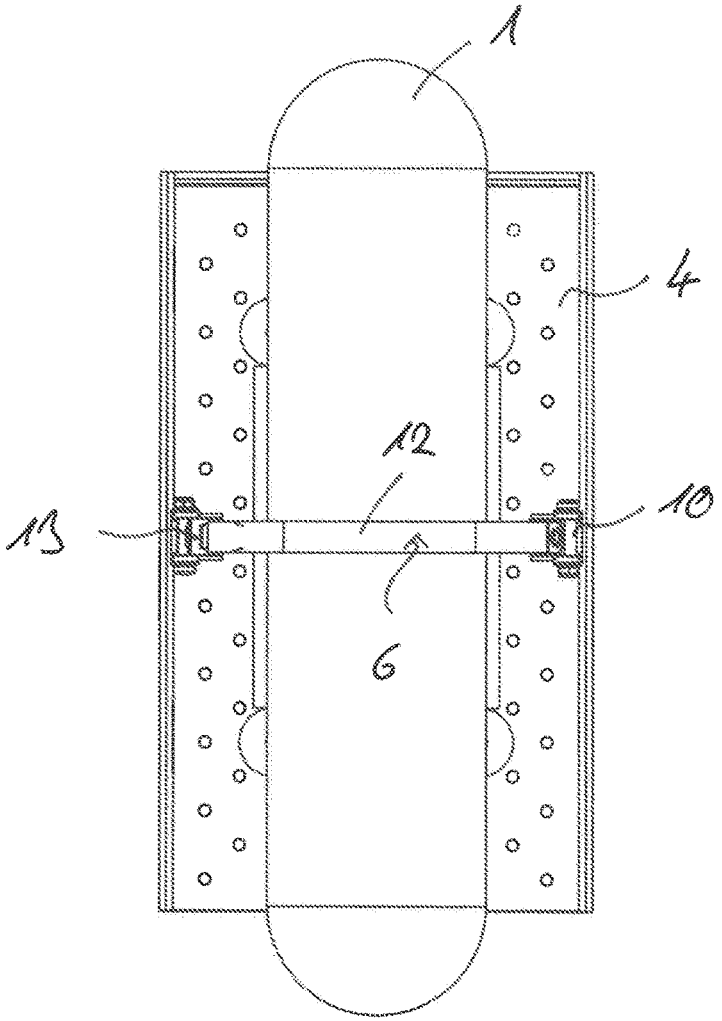
Figure 4:
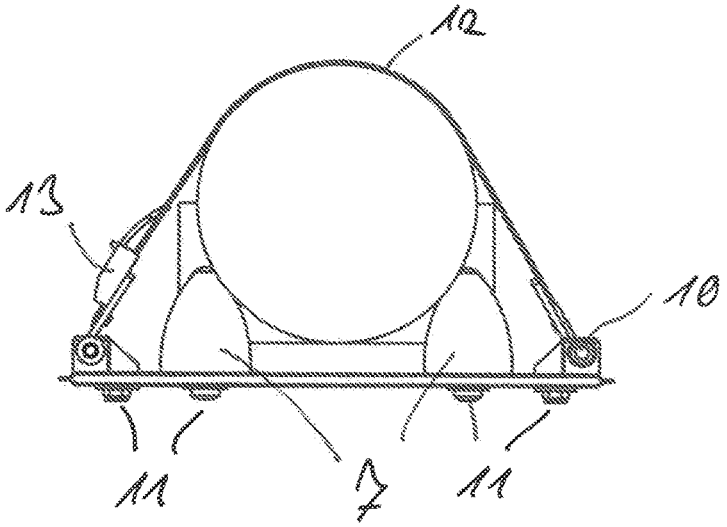
FIG. 4: the load carrier according to the disclosure in a top view.
Figure 5:
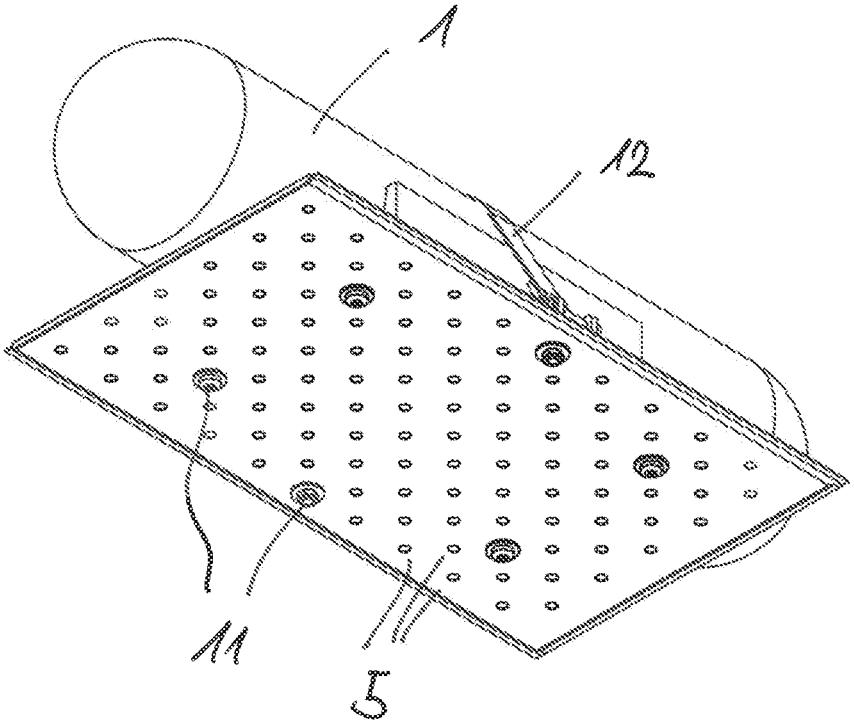
FIG. 5: A perspective view of the load carrier according to the disclosure from the side facing the back of the wearer.
Figure 6:
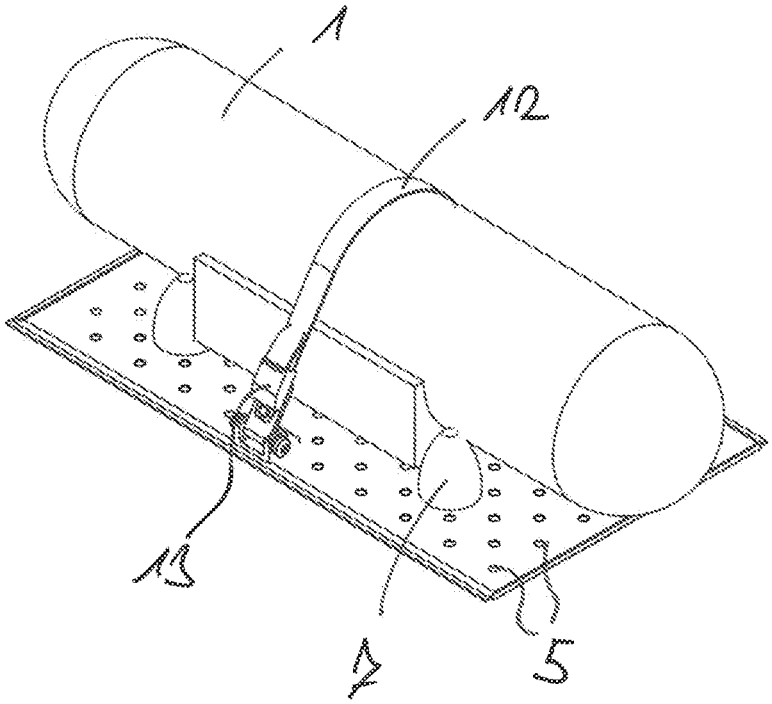
FIG. 6: a perspective view of the load carrier in a view from that side which faces away from the back of the wearer.

A fourth aspect of the present disclosure can be taken from FIGS. 1 and 2. According to this aspect, the shoulder straps 3 are not directly connected to the load carrier 2 according to the present disclosure. Rather, the shoulder straps are arranged on a carrying frame 8, on which in turn the load carrier 2 is arranged. This embodiment permits much more ergonomic carrying. Preferably, the carrying frame has adjustment options for adapting to the respective wearer, in particular an adjustment device for adjusting the height of the shoulder straps.

The carrying frame may further comprise a waist belt 9. In particular, the carrying frame 8 connects the shoulder straps and the waist belt to one another.

The load carrier, and in particular the carrying plate 4, can preferably be releasably connected to the carrying frame 8. As described briefly above, this can be done, for example, by connecting the carrying plate to the carrying frame 8 via zippers and/or via a pocket which is slipped over the upper part of the carrying frame.

The carrying frame 8 therefore represents an independent element, which as such can be carried by a wearer in the manner of a backpack. The load carrier according to the disclosure can be releasably attached to this carrying frame 8.

Preferred embodiments of the present disclosure, which may be used in any of the aspects of the disclosure, are described in more detail below.

In particular, several identical positioning elements can be used.

In particular, several identical positioning elements tapering in one direction, as have been described above, can be used.

Furthermore, several types of positioning elements can be used, which differ only by their size, in particular several types of positioning elements tapering in one direction, as described above.

Furthermore, in addition to or instead of these elements, one or more positioning elements, which have a flat top side, can be used.

The outer contour of the positioning elements is preferably formed by an elastic material, in particular rubber. In particular, the positioning elements can be rubber elements.

In the exemplary embodiment, the clamping elements 6, 6' each comprise a strap element 12, which is received on a strap-receiving element 13 in order to tension the item of equipment with the positioning elements 7, 7'. The strap-receiving element 13 is in particular a tensioning ratchet with which the strap element 12 can be tightened.

The strap element 12 and the tensioning ratchet 13 are preferably each connected via a swivel joint to a fastening element, which in turn can be fastened to a recess in the carrying plate 4. In the case of the strap element 12, the corresponding fastening element is denoted by reference character 10. The strap element can be made of plastic. In one possible embodiment, it has locking edges which interact with the tensioning ratchet.

In the exemplary embodiment shown in FIGS. 1 to 10, the strap element 12 and the strap-receiving element 13 can be arranged independently of one another on recesses 5 of the carrying plate 4. In particular, this also allows the distance between the respective fastening elements of the strap element 12 and the strap-receiving element 13 to be freely set.

In the exemplary embodiment shown in FIGS. 11 and 12, on the other hand, the strap element 12 and the strap-receiving element 13 are arranged on a common base element 17, which in turn is fastened to one or more recesses 5 of the carrying plate 4'. This determines the distance between the axis of rotation with which the strap element 12 is arranged on the base element and the axis of rotation with which the strap-receiving element 13 is arranged on the latter.

Preferably, however, it is also provided in this embodiment that the clamping element and the positioning elements are configured in such a way that the item of equipment is clamped only via the strap element 12 with the positioning elements, and does not come into contact with the base element 17. Alternatively, however, clamping with the base element could also be selected.

In the first exemplary embodiment shown in FIGS. 1 to 10, the carrying plate 4 has a plurality of recesses 5 distributed over the carrying plate, to which the positioning elements 7 and/or the clamping elements 6 can be fastened in different arrangements in each case in order to adapt the load carrier to different items of equipment 1. In particular, the recesses 5 are distributed over the carrying plate 4 in the form of a grid, in particular a regular grid, as can be seen, for example, in FIGS. 9 and 10.

The carrying system can be provided with a set of positioning elements 7 and/or clamping elements 6, which can be attached to the carrying plate 4 in a different arrangement depending on the item of equipment 1 to be transported, in order to securely transport the respective item of equipment 1.

The first exemplary embodiment shown in FIGS. 1 to 10 thus allows flexibly adapting of the carrying system to different items of equipment.

In the second embodiment of the carrying system shown in FIGS. 11 and 12, on the other hand, the positions of the recesses 5 are adapted to a specific item of equipment, and additional recesses have been dispensed with. If the carrying system is used in large numbers for transporting the same item of equipment, this version is less expensive to manufacture, since recesses that are not required can be dispensed with. Furthermore, specific adaption of the arrangement of the recesses and thus of the positioning elements and the clamping elements to the specific shape of the item of equipment is possible in an even more specific manner.

In this embodiment, the recesses 5 are therefore arranged irregularly, with a clamping element and/or positioning element being provided at each recess. FIGS. 1-12 are drawn to scale, although other relative dimensions may be used if desired. Further, whether or not embodiments are described distinctly, common features among the embodiments are illustrated and further features shown in one embodiment may be applied in combination with other embodiments.

The carrying system according to the disclosure can be used in many fields. In particular, it allows the transport of items of equipment in the military field, especially the transport of weapons and/or weapon components.

The invention claimed is:

1. Carrying system for an item of equipment, comprising a load carrier which can be carried via shoulder straps, wherein the load carrier comprises a carrying plate having a plurality of recesses, at least one clamping element and at least one positioning element, wherein the at least one clamping element and the at least one positioning element are each arranged or arrangeable on at least one recess of the carrying plate, wherein a plurality of positioning elements are provided, against which the item of equipment can be clamped by the clamping element, wherein the positioning elements are arranged or arrangeable on both sides of the clamping element, so that, in the clamped state, the item of equipment rests against the positioning elements on both sides of the clamping element, wherein an outer contour of the at least one positioning element has a shape tapering in a direction away from the carrying plate and a rotational symmetry, wherein a part of the at least one positioning element that has a shape tapering continuously in the direction away from the carrying plate, with a height of the part being at least 50% of the total height of the positioning element, the height being measured in a direction perpendicular to the carrying plate.

2. Carrying system according to claim 1, wherein the positioning elements and the clamping element are arranged or arrangeable in such a way that the load input into the carrying plate takes place exclusively via the clamping element(s) and the positioning elements.

3. Carrying system according to claim 1, wherein the positioning elements and the clamping element are arranged or arrangeable such that the item of equipment is fixed by the at least one clamping element between positioning elements arranged on both sides of the clamping element and on both sides of a main direction of the item of equipment extending transversely to the clamping element.

4. Carrying system according to claim 1, wherein the outer contour of the at least one positioning element has a shape tapering continuously in the direction away from the carrying plate.

5. Carrying system according to claim 1, wherein an axis of symmetry of the outer contour of the at least one positioning element is perpendicular to the carrying plate.

6. Carrying system according to claim 1, wherein the carrying plate is sewn into a fabric pocket, wherein the recesses in the carrying plate are formed by holes, wherein cutouts are provided in the material of the fabric pocket which match the holes.

7. Carrying system according to claim 6, wherein the carrying plate consists of an aluminum-plastic laminate material.

8. Carrying system according to claim 6, wherein the carrying plate is connected and/or connectable to the shoulder straps via the fabric pocket, wherein the connection is a releasable connection and one or more fastening elements are provided on the fabric pocket for fastening with the shoulder straps.

9. Carrying system according to claim 1, comprising:

a carrying frame comprising the shoulder straps arranged on the carrying frame, wherein the carrying frame further comprises a waist belt, wherein the carrying frame connects the shoulder straps and the waist belt to one another, and wherein the load carrier is releasably fastened to the carrying frame.

10. Carrying system according to claim 1, comprising a plurality of identical positioning elements.

11. Carrying system according to claim 1, comprising one or more first and second positioning elements having different sizes and/or different shapes.

12. Carrying system according to claim 1, comprising at least four positioning elements.

13. Carrying system according to claim 1, wherein the positioning element(s) and/or clamping element(s) are screwed and/or screwable to the carrying plate, wherein a threaded pin is arranged on the positioning element(s) and/or clamping element(s) in each case and can be screwed to a nut provided on the backside of the carrying plate facing the body of the wearer, and/or wherein in each case a female thread is arranged on the positioning element or elements and/or clamping elements and can be screwed to a screw, the head of which is provided on the rear side of the carrying plate facing the body of the wearer.

14. Carrying system according to claim 1, wherein the carrying plate comprises a plurality of recesses arranged in a grid, at which the positioning element(s) and clamping element(s) can be arranged in different positions for adapting to different items of equipment.

15. Carrying system according to claim 1, wherein the carrying plate comprises a plurality of recesses which, with regard to their position, are specifically adapted to the item of equipment to be carried, and on which the positioning element(s) and clamping element(s) for holding the item of equipment are provided in a defined arrangement.

16. Carrying system according to claim 1, comprising a set of positioning elements and/or clamping elements which are usable for adapting to different items of equipment in different combinations and/or arrangements.

17. Set, composed of a carrying system according to claim 1 and the at least one item of equipment which is fastenable and/or fastened to the load carrier.

18. Use of a carrying system according to claim 1 for transporting an item of equipment, wherein the item of equipment, the positioning elements and the clamping element are arranged in such a way that the load input into the carrying plate takes place exclusively via the clamping element(s) and the positioning elements.

19. Carrying system according to claim 1, wherein a maximum width of the at least one positioning element, measured in a direction parallel to the carrying plate, is at least 40% of the total height of the at least one positioning element.

20. Carrying system according to claim 1, wherein the at least one positioning element is made from an elastic material.

21. Carrying system for an item of equipment, comprising a load carrier which can be carried via shoulder straps, wherein the load carrier comprises a carrying plate having a plurality of recesses, at least one clamping element and at least one positioning element, wherein the at least one clamping element and the at least one positioning element are each arranged or arrangeable on at least one recess of the carrying plate, wherein a plurality of positioning elements are provided, against which the item of equipment can be clamped by the clamping element, wherein the positioning elements are arranged or arrangeable on both sides of the clamping element, so that, in the clamped state, the item of equipment rests against the positioning elements on both sides of the clamping element, wherein an outer contour of the at least one positioning element has a shape tapering in a direction away from the carrying plate and a rotational symmetry, wherein the at least one clamping element comprises a strap element and a strap-receiving element, wherein the strap element has locking edges and wherein the strap-receiving element comprises a tensioning ratchet.

22. Carrying system for an item of equipment, comprising a load carrier which can be carried via shoulder straps, wherein the load carrier comprises a carrying plate having a plurality of recesses, at least one clamping element and at least one positioning element, wherein the at least one clamping element and the at least one positioning element are each arranged or arrangeable on at least one recess of the carrying plate, wherein a plurality of positioning elements are provided, against which the item of equipment can be clamped by the clamping element, wherein the positioning elements are arranged or arrangeable on both sides of the clamping element, so that, in the clamped state, the item of equipment rests against the positioning elements on both sides of the clamping element, wherein an outer contour of the at least one positioning element has a rotational symmetry, and wherein the at least one positioning element is made from an elastic material.

23. Carrying system according to claim 22, wherein the elastic material is rubber.

* * * * *